US009687693B2

(12) United States Patent
Archer

(10) Patent No.: US 9,687,693 B2
(45) Date of Patent: Jun. 27, 2017

(54) EXERCISE APPARATUS

(71) Applicant: Archer Innovation Pty Ltd, Hamilton NSW (AU)

(72) Inventor: Todd Archer, Hamilton (AU)

(73) Assignee: Archer Innovations Pty Ltd, Hamilton NSW (AU)

( * ) Notice: Subject to any disclaimer, the term of this patent is extended or adjusted under 35 U.S.C. 154(b) by 0 days.

(21) Appl. No.: 14/863,111

(22) Filed: Sep. 23, 2015

(65) Prior Publication Data

US 2016/0089564 A1 Mar. 31, 2016

(30) Foreign Application Priority Data

Sep. 23, 2014 (AU) ..... 2014903805

(51) Int. Cl.
*A63B 26/00* (2006.01)
*A63B 23/02* (2006.01)
(Continued)

(52) U.S. Cl.
CPC ..... *A63B 23/0211* (2013.01); *A63B 69/0057* (2013.01); *A63B 21/4049* (2015.10);
(Continued)

(58) Field of Classification Search
CPC ..... A63B 1/00; A63B 3/00; A63B 21/00047; A63B 21/0005; A63B 21/00054; A63B 21/00185; A63B 21/00189; A63B 21/008; A63B 21/0085; A63B 21/04; A63B 21/0407; A63B 21/0414; A63B 21/0421; A63B 21/0428; A63B 21/0435; A63B 21/0442; A63B 21/05; A63B 21/06; A63B 21/0601; A63B 21/0602; A63B 21/065; A63B 21/068; A63B 21/08; A63B 21/0427; A63B 21/4029; A63B 21/4031; A63B 21/4033; A63B 21/4034; A63B 21/4035; A63B 21/4039; A63B 21/4045; A63B 21/4047; A63B 21/4049; A63B 23/02; A63B 23/0205; A63B 23/0211; A63B 23/0233; A63B 41/00; A63B 69/0057; A63B 69/0059; A63B 2069/0062;
(Continued)

(56) References Cited

U.S. PATENT DOCUMENTS 4,337,942 A * 7/1982 Sidlinger ..... A63B 5/11 482/142
4,508,335 A * 4/1985 Kelley ..... A63B 23/0211 482/140
(Continued)

*Primary Examiner* — Loan H Tranh
*Assistant Examiner* — Gary D Urbiel Goldner
(74) *Attorney, Agent, or Firm* — Seed IP Law Group LLP

(57) ABSTRACT

An exercise apparatus for exercising core muscles of a user, the exercise apparatus comprising: a base; at least two support beams extending from the base and adapted to receive an exercise ball; a support stem extending substantially vertically from the base; a leg support bar located at a distal end of the support stem and disposed substantially horizontally with respect to the base; a first locking pad disposed at a proximal end of the leg support bar adapted to engage a posterior surface of the user's knees; and a second locking pad disposed at a distal end of the leg support bar adapted to engage an anterior surface of the user's lower leg.

19 Claims, 10 Drawing Sheets

(51) Int. Cl.
*A63B 69/00* (2006.01)
*A63B 21/00* (2006.01)

(52) U.S. Cl.
CPC ... *A63B 2069/0062* (2013.01); *A63B 2225/09* (2013.01); *A63B 2225/093* (2013.01)

(58) Field of Classification Search
CPC .... A63B 2208/0228; A63B 2208/0233; A63B 2208/0238; A63B 2225/09; A63B 2225/093; A63B 2225/62; A63B 2023/006; A63B 26/00
USPC ..... 482/907
See application file for complete search history.

(56) References Cited

U.S. PATENT DOCUMENTS 5,135,459 A * 8/1992 Perry, Jr. ..... A63B 21/00047 482/144
5,176,603 A * 1/1993 Hundley ..... A63B 21/4029 482/140
5,190,513 A * 3/1993 Habing ..... A63B 23/0211 482/140
5,203,755 A * 4/1993 Kaiser ..... A61H 1/0218 482/142
5,221,246 A * 6/1993 Torii ..... A63B 21/00054 482/121
5,295,936 A * 3/1994 Perry, Jr. ..... A63B 21/00047 482/134
D366,917 S * 2/1996 Clem ..... D21/690
5,499,961 A * 3/1996 Mattox ..... A63B 21/055 482/123
5,632,710 A * 5/1997 England ..... A63B 23/0211 482/127
5,961,428 A * 10/1999 Webber ..... A63B 21/154 482/100
5,980,434 A * 11/1999 Webber ..... A63B 23/0494 482/100
6,048,293 A * 4/2000 Lee ..... A63B 23/0211 482/140
6,375,601 B1 * 4/2002 Johnson ..... A61H 1/0292 297/452.13
6,461,284 B1 * 10/2002 Francavilla ..... A61H 1/0218 482/121
6,482,139 B1 * 11/2002 Haag ..... A63B 21/0552 482/121
6,547,706 B1 * 4/2003 Chek ..... A63B 21/02 482/132
D476,705 S * 7/2003 Dillard ..... D21/662
6,685,603 B1 * 2/2004 Teeter ..... A61H 1/0218 482/140
6,689,026 B2 * 2/2004 Almada ..... A63B 23/0211 446/220
7,104,939 B1 * 9/2006 Martinez ..... A63B 21/068 482/142
7,118,517 B1 * 10/2006 Hale ..... A63B 21/4015 482/140
D573,672 S * 7/2008 Hsu ..... D21/662
7,662,077 B1 * 2/2010 Liu ..... A63B 23/02 482/142
7,819,781 B1 * 10/2010 Maldonado ..... A63B 21/00047 482/130
8,096,930 B1 * 1/2012 Leon ..... A63B 21/00181 482/130
8,540,519 B1 * 9/2013 Lauter ..... A63B 26/003 434/247
8,696,532 B1 * 4/2014 Peterson ..... A63B 69/0057 482/131
9,180,329 B2 * 11/2015 Doane ..... A63B 21/00047
9,242,139 B2 * 1/2016 Holley ..... A63B 23/02
9,302,149 B1 * 4/2016 Parker ..... A63B 23/0211
9,370,688 B1 * 6/2016 Pannozzo ..... A63B 23/0405
2002/0151419 A1 * 10/2002 Barnes ..... A63B 21/00072 482/142
2003/0130097 A1 * 7/2003 Harrison ..... A63B 21/0552 482/122
2004/0033872 A1 * 2/2004 Nizamuddin .... A63B 21/00047 482/142
2005/0079964 A1 * 4/2005 Francavilla ..... A63B 23/0233 482/142
2006/0217249 A1 * 9/2006 Webber ..... A63B 23/02 482/142
2008/0096744 A1 * 4/2008 Perry ..... A61H 1/0218 482/144
2010/0125030 A1 * 5/2010 Shifferaw ..... A63B 21/4047 482/94
2011/0143890 A1 * 6/2011 Reyes ..... A63B 21/154 482/99
2011/0319237 A1 * 12/2011 Jones ..... A63B 21/00047 482/140
2012/0190513 A1 * 7/2012 Bonds ..... A63B 21/008 482/114
2013/0197403 A1 * 8/2013 Sevy ..... A63B 21/0442 601/5
2013/0210588 A1 * 8/2013 Derrick ..... A63B 21/068 482/96
2014/0038798 A1 * 2/2014 Littell ..... A63B 26/00 482/145
2014/0066275 A1 * 3/2014 Miller, Jr. ..... A63B 21/068 482/142
2016/0045780 A1 * 2/2016 Henniger ..... A63B 23/0222 482/145

* cited by examiner

EXERCISE APPARATUS

FIELD OF THE INVENTION

The present invention relates to apparatus for conducting an exercise and in particular to exercise apparatus with improved posture support.

The invention has been developed primarily for use as an apparatus to assist in performing a physical exercise whilst providing improved support for the exerciser and will be described hereinafter with reference to this application. However, it will be appreciated that the invention is not limited to this particular field of use.

BACKGROUND

Any discussion of the background art throughout the specification should in no way be considered as an admission that such background art is prior art nor that such background art is widely known or forms part of the common general knowledge in the field.

Conventional sit-up exercises performed on a flat surface such as the floor or a matt are notoriously famous for causing discomfort in the exerciser, particularly in their lower back and tail bone, since the back is not supported during the exercise.

As an alternative, sit-up exercises can be performed on an exercise ball to provide support to the exerciser's back. However, due to the arching of the back and that in position on the exercise ball, the exerciser's thighs are parallel to the torso which, again, puts undue strain on the lower back. Also, the range of motion of the exercise is restricted when using an exercise ball as the users' legs are not secured and the risk of overbalancing increases as the upper body extends through a full back arch.

SUMMARY

It is an object of the present invention to overcome or ameliorate at least one of the disadvantages of the prior art, or to provide a useful alternative.

Disclosed herein are exercise apparatus designed to overcome or at least ameliorate the disadvantages of common existing methods of performing sit-ups. The apparatus disclosed herein allows the user to exercise through the full range of movement of the all-important core muscle group—which include the muscles around the torso, lower back, abdomen hips and pelvis that provide balance and stability.

The apparatus disclosed herein additionally allows the user fully engage the gravitational force exerted on the upper body as a form of resistance to engage the core muscles. The ergonomically correct position of the thighs at right angles to the torso, as provided by the apparatus, takes the strain off the exerciser's lower back. It is an object of the invention in its preferred form to provide an exercise apparatus for improved ergonomic performance of core muscle exercises.

According to a first aspect of the invention, there is provided an exercise apparatus for exercising the core muscles of a user. The exercise apparatus may comprise a base. The exercise apparatus may further comprise at least two support beams extending from the base and adapted to receive an exercise ball. The exercise apparatus may further comprise a support stem extending substantially vertically from the base. The exercise apparatus may further comprise a leg support bar located at a distal end of the support stem and disposed substantially horizontally with respect to the base. The exercise apparatus may further comprise a first locking pad disposed at a proximal end of the leg support bar adapted to engage the posterior surface of the user's knees. The exercise apparatus may further comprise a second locking pad disposed at a distal end of the leg support bar adapted to engage the anterior surface of the user's lower leg. In use, a user may engage their legs with the first and second locking pads and whose weight is supported by an exercise ball located in engagement with the support beams such that the user is able to perform an exercise through a full range of movement of the user's core muscle groups whilst remaining supported through the full range of movement.

According to an arrangement of the first aspect, there is provided an exercise apparatus for exercising the core muscles of a user comprising: a base; at least two support beams extending from the base and adapted to receive an exercise ball; a support stem extending substantially vertically from the base; a leg support bar located at a distal end of the support stem and disposed substantially horizontally with respect to the base; a first locking pad disposed at a proximal end of the leg support bar adapted to engage the posterior surface of the user's knees; a second locking pad disposed at a distal end of the leg support bar adapted to engage the anterior surface of the user's lower leg; wherein, in use, a user engages their legs with the first and second locking pads and whose weight is supported by an exercise ball located in engagement with the support beams such that the user is able to perform an exercise through a full range of movement of the user's core muscle groups whilst remaining supported through the full range of movement.

The support stem may be height adjustable. The support stem may comprise a locking mechanism to secure the support stem at a desired height. The locking mechanism may comprise a locking pin. The support stem may also be adjusted in a plane perpendicular to the support beams. The support stem may be secured in place with a locking bolt.

The leg support bar may be pivotable with respect to the support stem. The pivotable leg support bar may be secured to the support stem by a pivot joint. The pivot joint may enable rotation of the leg support bar about the support stem having the pivot joint forming the pivot point for the rotation. The rotation about the support stem may be in the horizontal plane. The pivot joint may enable adjustment of the pitch of the leg support bar with respect to a horizontal plane. The pitch adjustment of the leg support bar may be in a vertical plane. The leg support bar may be rotatable about a central axis such that the support pads are rotated to be disposed vertically with respect to the ground.

The leg support bar may be length-adjustable such that adjustment of the length of the leg support bar acts to vary the distance between the proximal and distal ends of the leg support bar and hence also the distance between the first and second locking pads thereby to comfortably accommodate users of different height.

The apparatus may further comprise a foot locking bar located at the distal end of the leg support bar to permit the user to lock their ankle and/or shin against the distal leg support bar through exertion of a force through the foot bar pushing the user's shin against a resilient substance or padding associated with the distal leg support bar to provide a secure pressure against the distal leg support bar.

The first and second locking pads may comprise a resilient substance to prevent discomfort to the user whilst performing core muscle exercises.

The exercise apparatus may further comprise further comprise one or more handles to assist the user when mounting or dismounting from the exercise apparatus.

BRIEF DESCRIPTION OF THE DRAWINGS

Notwithstanding any other forms which may fall within the scope of the present invention a preferred embodiment/preferred arrangements of the invention will now be described, by way of example only, with reference to the accompanying drawings in which.

DEFINITIONS

Figure 1:
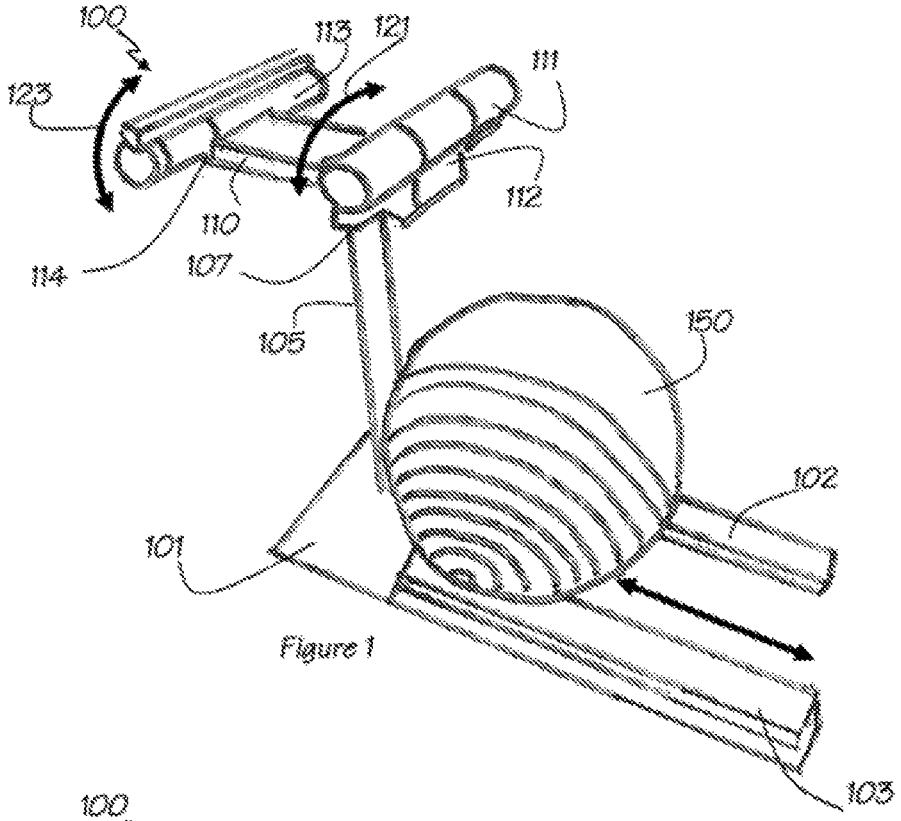
FIG. 1 is a schematic depiction of an exercise apparatus according to the invention.

The following definitions are provided as general definitions and should in no way limit the scope of the present invention to those terms alone, but are put forth for a better understanding of the following description.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein. For the purposes of the present invention, additional terms are defined below. Furthermore, all definitions, as defined and used herein, should be understood to control over dictionary definitions, definitions in documents incorporated by reference, and/or ordinary meanings of the defined terms unless there is doubt as to the meaning of a particular term, in which case the common dictionary definition and/or common usage of the term will prevail.

The terminology used herein is for the purpose of describing particular embodiments only and is not intended to be limiting of the invention. As used herein, the singular articles "a", "an" and "the" are intended to include the plural forms as well, unless the context clearly indicates otherwise and thus are used herein to refer to one or to more than one (i.e. to "at least one") of the grammatical object of the article. By way of example, the phrase "an element" refers to one element or more than one element.

The term "about" is used herein to refer to quantities that vary by as much as 30%, preferably by as much as 20%, and more preferably by as much as 10% to a reference quantity. The use of the word 'about' to qualify a number is merely an express indication that the number is not to be construed as a precise value.

Throughout this specification, unless the context requires otherwise, the words "comprise", "comprises" and "comprising" will be understood to imply the inclusion of a stated step or element or group of steps or elements but not the exclusion of any other step or element or group of steps or elements.

As used herein, the term "exemplary" is used in the sense of providing examples, as opposed to indicating quality. That is, an "exemplary embodiment" is an embodiment provided as an example, as opposed to necessarily being an embodiment of exemplary quality for example serving as a desirable model or representing the best of its kind.

Also, various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of" will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the summary above and the description below, all transitional phrases such as "comprising," "including," "carrying," "having," "containing," "involving," "holding," "composed of," and the like are to be understood to be open-ended, i.e., to mean "including but not limited to". Only the transitional phrases "consisting of" and "consisting essentially of" alone shall be closed or semi-closed transitional phrases, respectively.

For the purpose of this specification, where method steps are described in sequence, the sequence does not necessarily mean that the steps are to be carried out in chronological order in that sequence, unless there is no other logical manner of interpreting the sequence.

DESCRIPTION

It should be noted in the following description that like or the same reference numerals in different embodiments or arrangements denote the same or similar features.

Figure 2:
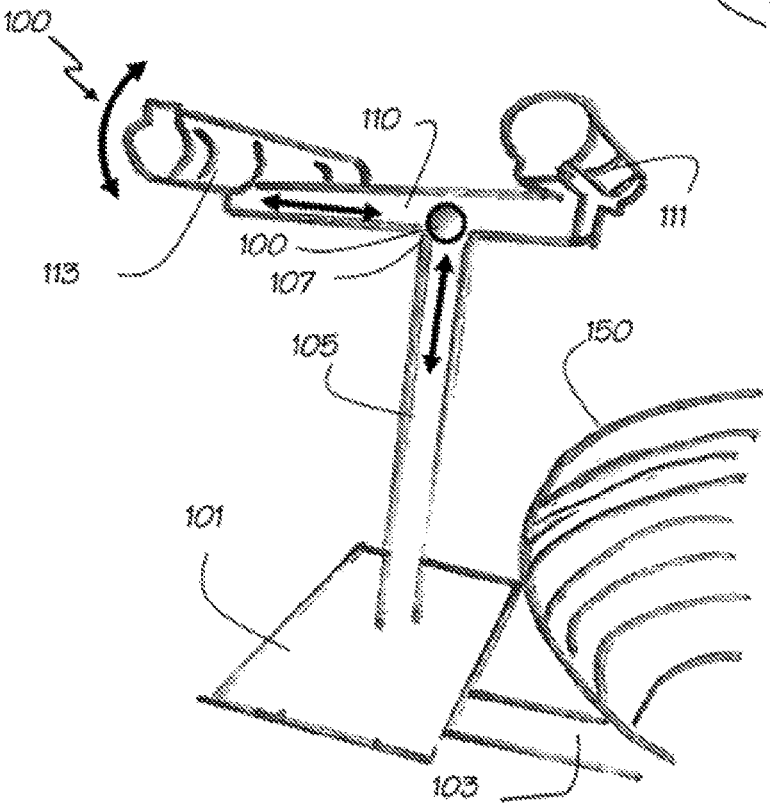
FIG. 2 is an enlarged schematic depiction of the forward portion of the exercise apparatus of FIG. 1.
Figure 3:
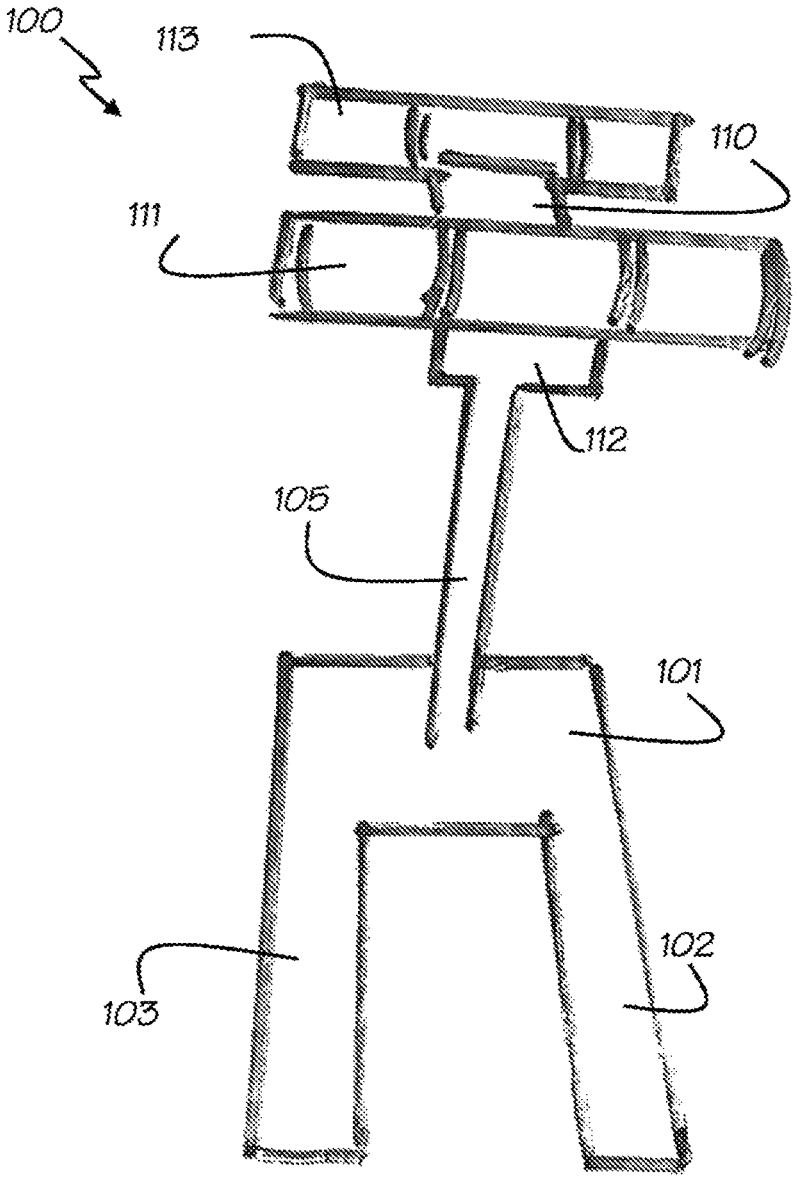
FIG. 3 is a further schematic depiction of the exercise apparatus of FIG. 1.

Referring to the FIGS. 1 to 3 of the drawings, the exercise apparatus 100 comprises a base 101. The exercise apparatus further comprises at least two support beams 102 and 103 extending from the base 101 and adapted to receive an exercise ball 150. In use, as seen in FIG. 4, support beams 102 and 103 support the weight of user 200 on top of exercise ball 150. Support beams 102 and 103 allow the exercise ball 150 to roll either closer or further away from the support stem 15 of apparatus 100 whilst the user is mounted. Support beams are also adapted to stop the exercise ball 150 from moving sideways, thereby providing stability to the user 200 whilst performing the exercises and also allowing the user 200 to vary their position safely (i.e. without the ball 150 rolling out from underneath them whilst the user 200 has their legs locked in the locking pads 111 and 113. The first and second locking pads 111 and 113 are preferably formed from a resilient substance (e.g. foam padding or the like) to prevent discomfort to the user 200 whilst performing core muscle exercises.

Figure 4A:
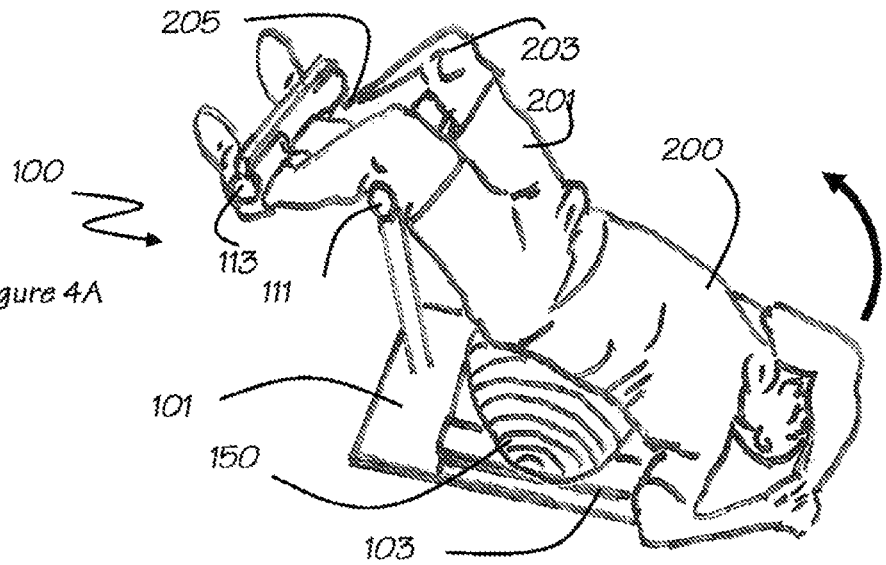
FIGS. 4A to 4C are depictions of a user mounted on the exercise apparatus of FIG. 1 and performing a core muscle exercise through a full range of motion.

The exercise apparatus 100 further comprises a support stem 105 extending substantially vertically from the base 101. The exercise apparatus comprises a leg support bar 110 located at a distal end 107 of the support stem 105 and disposed substantially horizontally with respect to the base 101. The exercise apparatus further comprises a first locking pad 111 disposed at a proximal end 112 of leg support bar 110. Locking pad 111 is adapted to engage the posterior surface of the user's knees as can be seen in FIG. 4A. The exercise apparatus further comprises a second locking pad 113 disposed at a distal end 114 of leg support bar 110. Locking pad 113 is adapted to engage the anterior surface of the user's lower leg as can be seen in FIG. 4A.

Figure 4B:
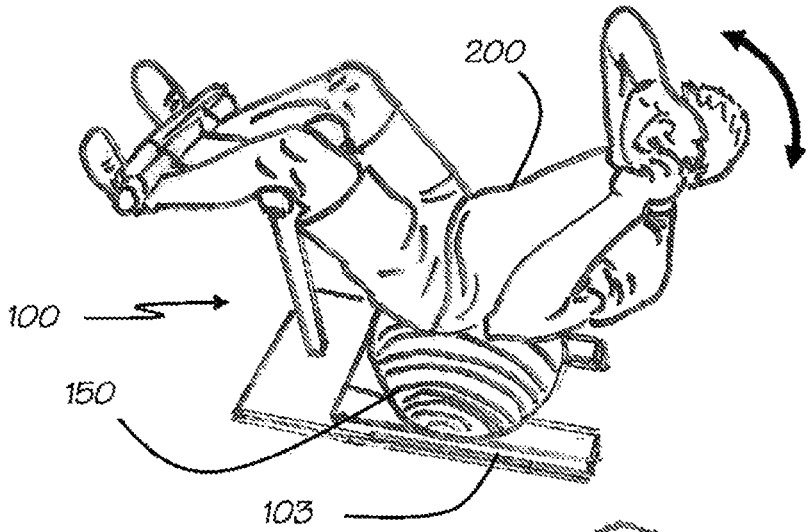
Figure 4C:
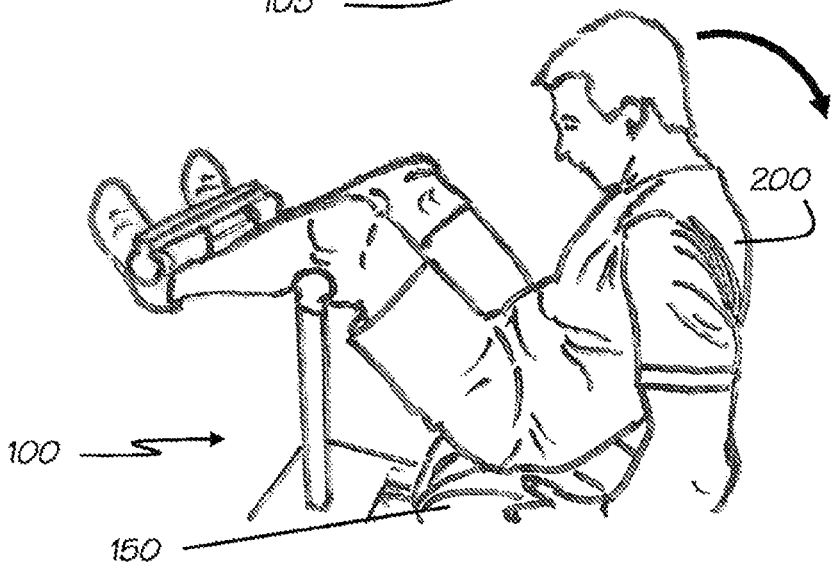
Figure 5A:
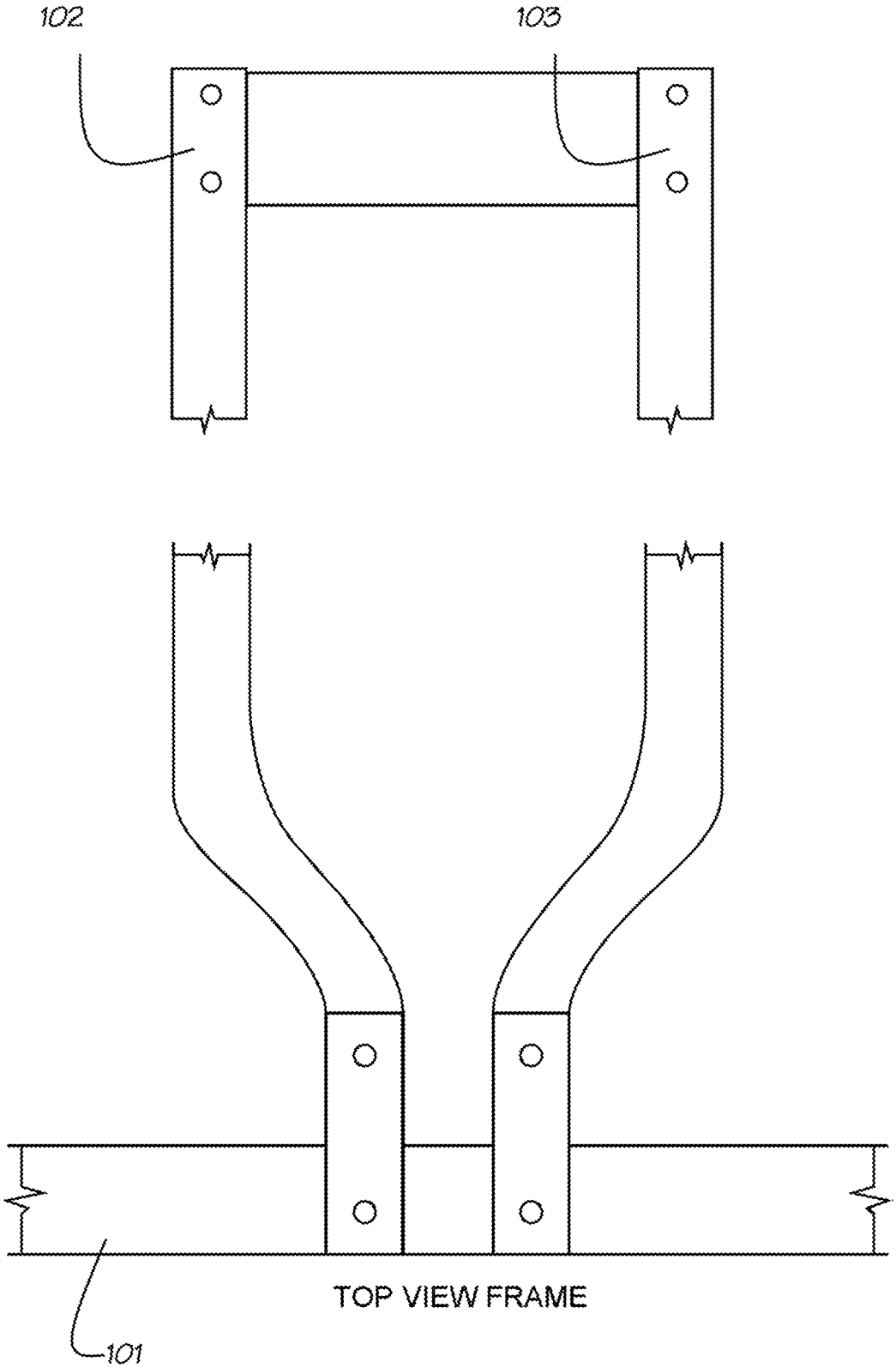
FIGS. 5A to 5D are schematic plans for an example arrangement of the exercise apparatus of FIGS. 1 to 3.
Figure 5B:
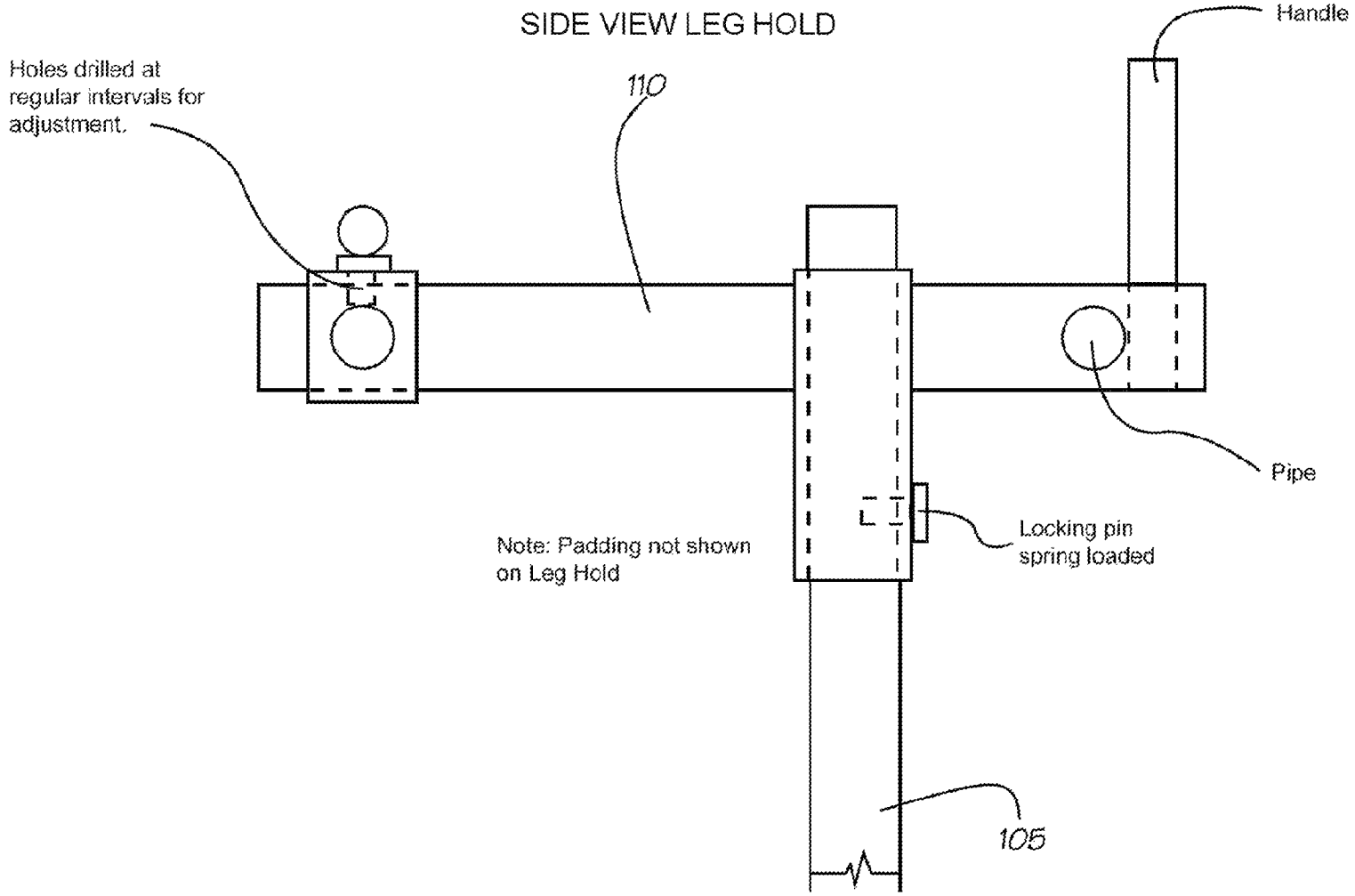
Figure 5C:
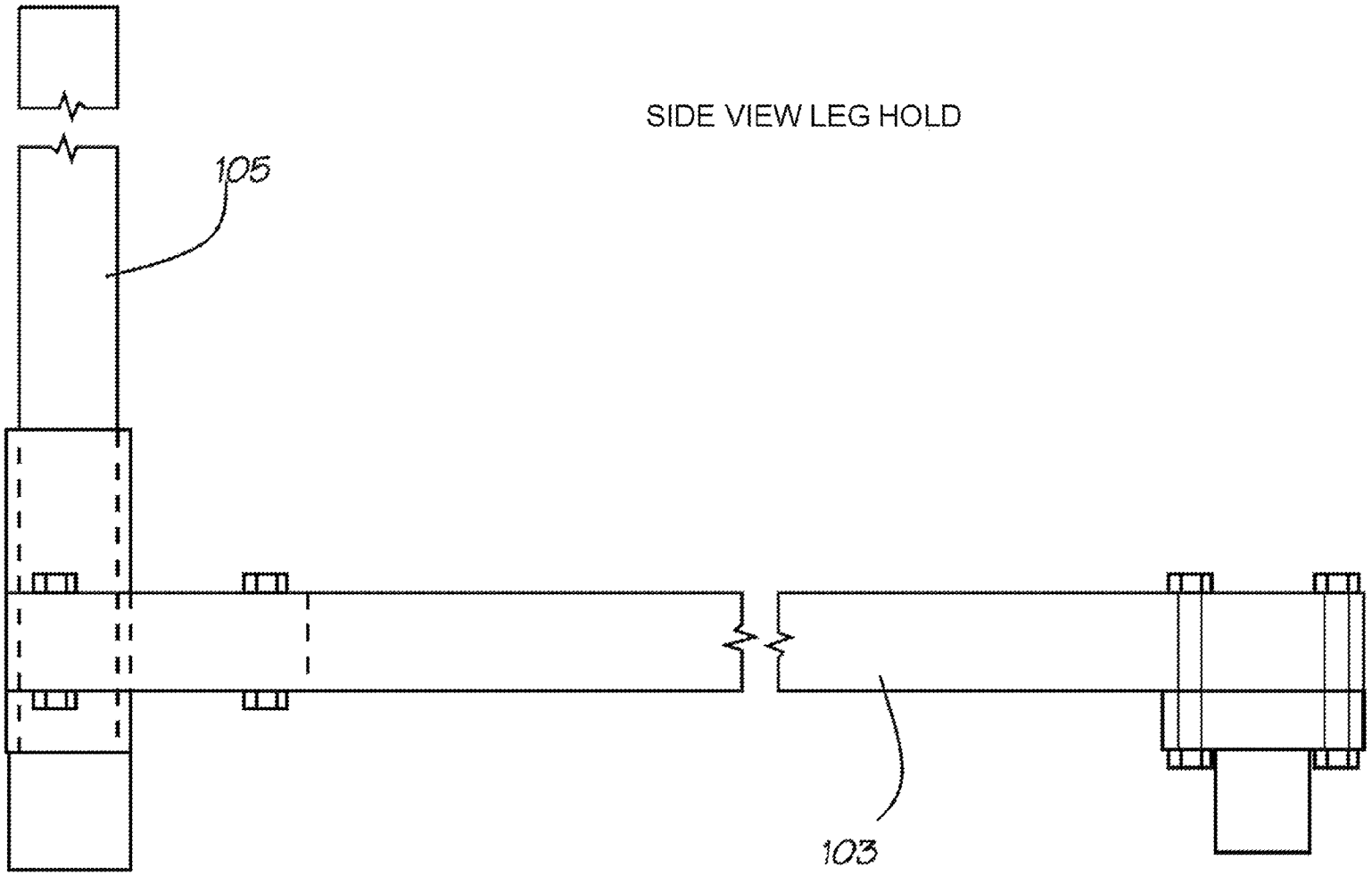
Figure 5D:
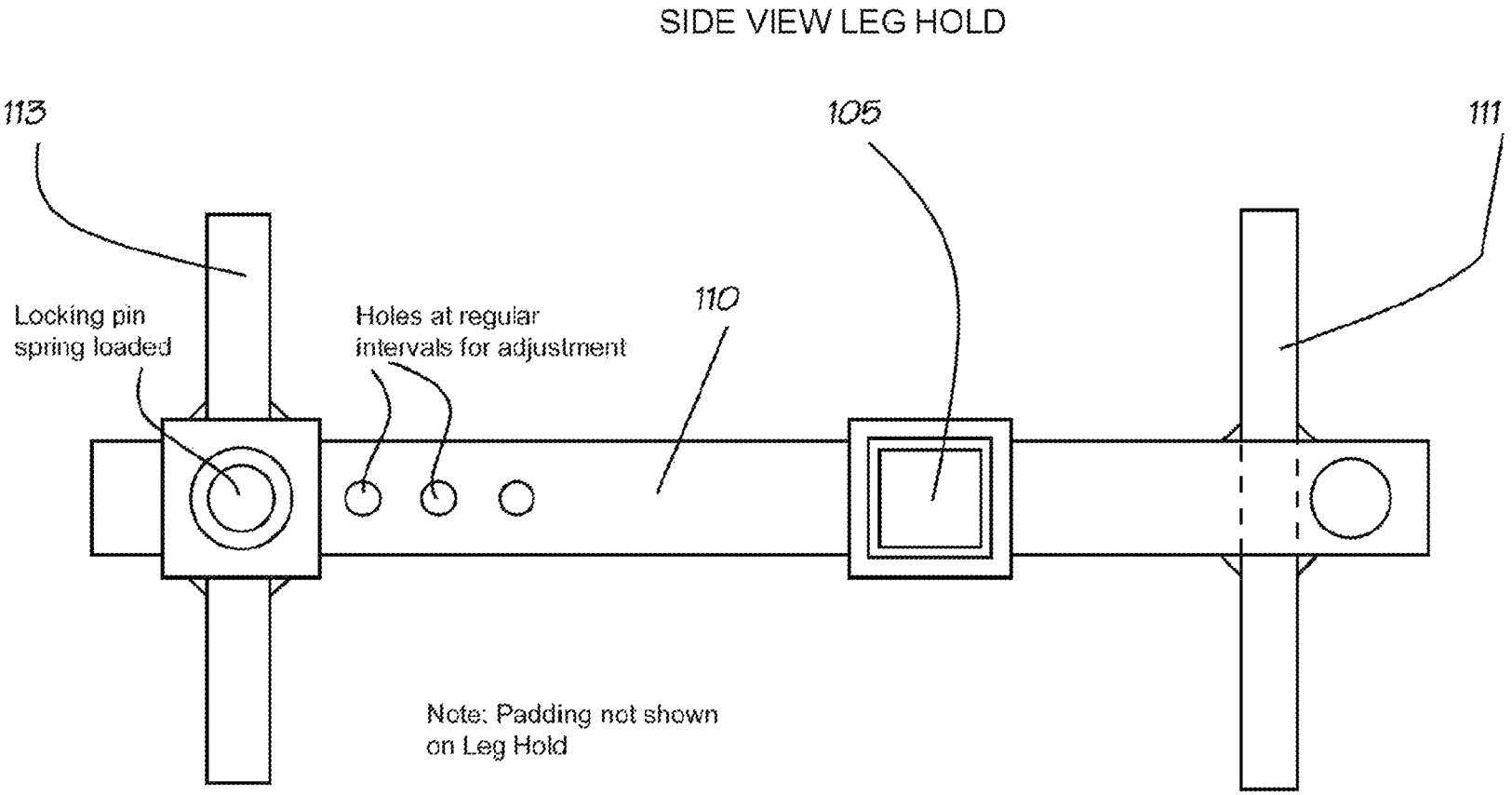

As can be seen in FIG. 4A, the apparatus 100 is designed to hold a user 200 in an elevated and variable position above an anti-burst exercise ball 150. The adjustable leg supports 111 and 113 lock the legs and pelvis in an ergonomically correct position above the anti-burst exercise ball 150. Additionally the apparatus 100 may comprise a foot locking bar 115 (see further embodiment 150 of apparatus 100 in FIGS. 6 to 7C) attached to leg support bar 110 and located at the distal end 114 of the leg support bar 110. In that manner, it is envisaged that the second locking pad 113 is disposed between the first locking pad 111 and the foot locking bar 115. As a result, the foot locking bar 115 is disposed distally of the second locking pad 113, to permit the user to lock their ankle and/or shin against the second locking pad 113, through exertion of a force through the foot locking bar 115 pushing the user's shin against a resilient substance or padding associated with the second locking pad 113 to provide a secure pressure against the foot locking bar 115. This position allows the user 200 to engage the core muscle groups through their full range of movement as seen in FIGS. 4A to 4C showing a sit-up through a full range of motion with gravity exerting a significant force on the torso which must be overcome by the user 200 to complete the exercise whilst maintaining the user 200 in a completely supported position throughout the entire range of movement. Since the exercise ball is constrained in its movement along support beams 102 and 103 to only be able to move forward and backward with respect to the support stem 105 and not sideways to cause instability for the user, the apparatus 100 allows the user 200 to vary their position on the exercise ball 150 and thus vary the motion of the exercise to targeting specific muscle groups such as, for example, the oblique muscles of the abdomen or more advanced exercises, such as, for example, a reverse plank. As the user adjusts their position on the exercise ball to work different muscle groups, the upright support stem 105 may also be adjusted in a plane perpendicular to the support beams 102 and 103 in directions along and perpendicular to the support stem 105, as indicated by arrows 105*a* and 105*b* of FIG. 6. This allows the user to center their hips over the exercise ball when side on exercising their obliques. The support stem 105 is secured in place with a locking bolt 106. The first and second locking pads 111 and 113 may also be rotated about the leg support bar 110 such that the support pads 111 and 113 are disposed vertically with respect to the ground (not shown).

In use as shown in FIGS. 4A to 4C, a user 200 engages their legs 201 with the first and second locking pads (111 and 113 respectively) where the anterior surface of user's 200 knees 203 are engaged with an upper surface of first locking pad 111 and the anterior surface 205 of user's 200 lower leg (i.e. shins or ankles) is engaged with a lower surface of second locking pad 113. The user's 200 weight is supported by exercise ball 150. Exercise ball 150 is located in engagement with support beams 102 and 130 of apparatus 100 such that the user 200 is able to perform an exercise through a full range of movement of the user's core muscle groups whilst remaining supported through the full range of movement as is shown in exercise sequence of FIGS. 4A to 4C. FIGS. 5A to 5D are schematic plans for an example arrangement of the exercise apparatus of FIGS. 1 to 3.

Figure 6:
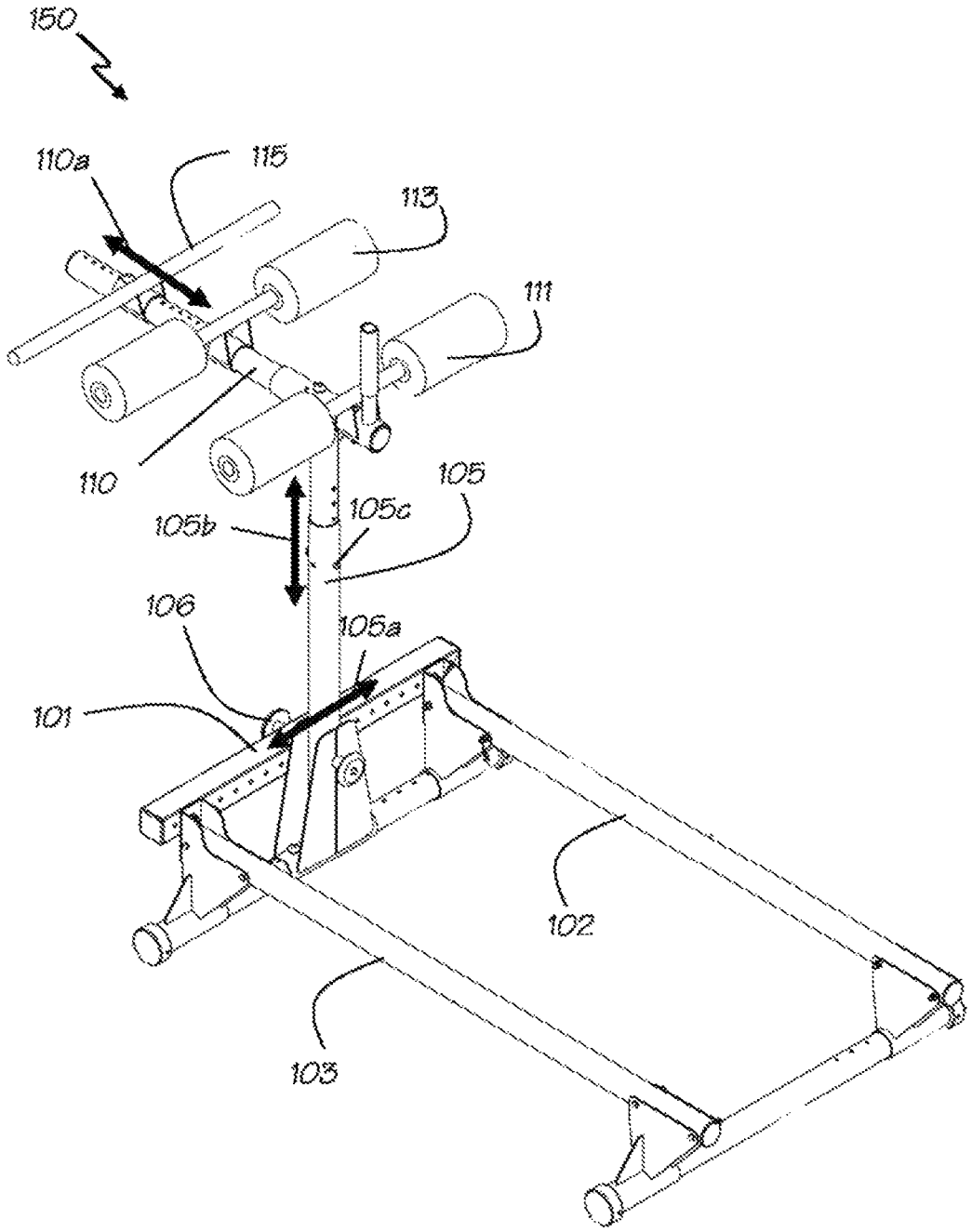
FIG. 6 shows a schematic depiction of a further embodiment 150 of exercise apparatus of FIG. 1.
Figure 7A:
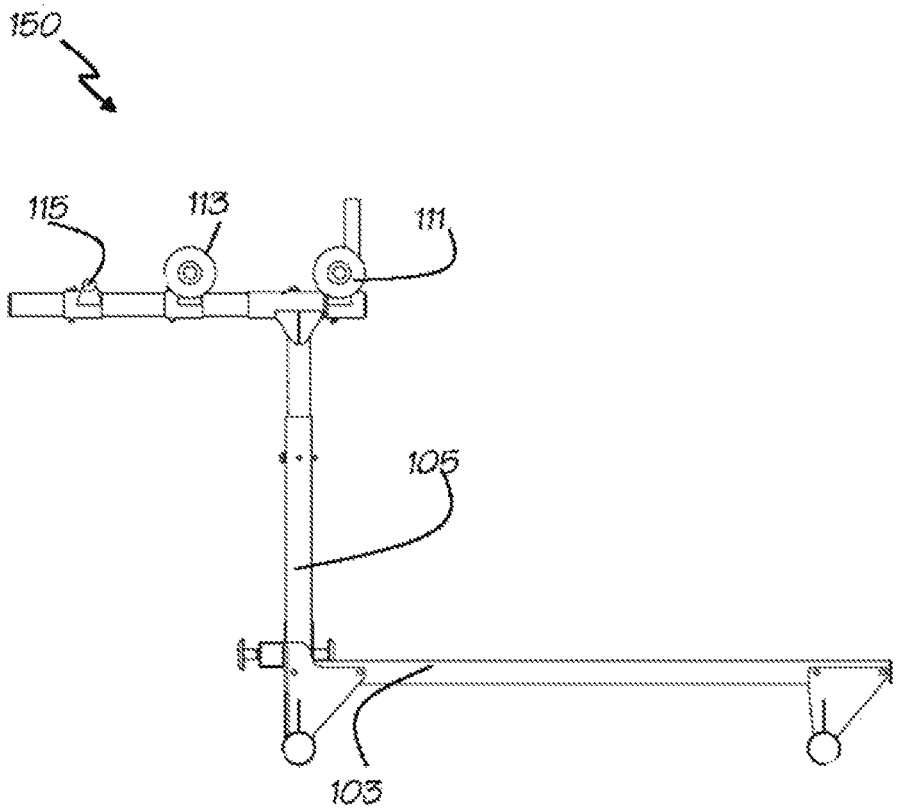
FIGS. 7A to 7C respectively show Side, Top and Rear elevation schematics of the apparatus of FIG. 6.
Figure 7B:
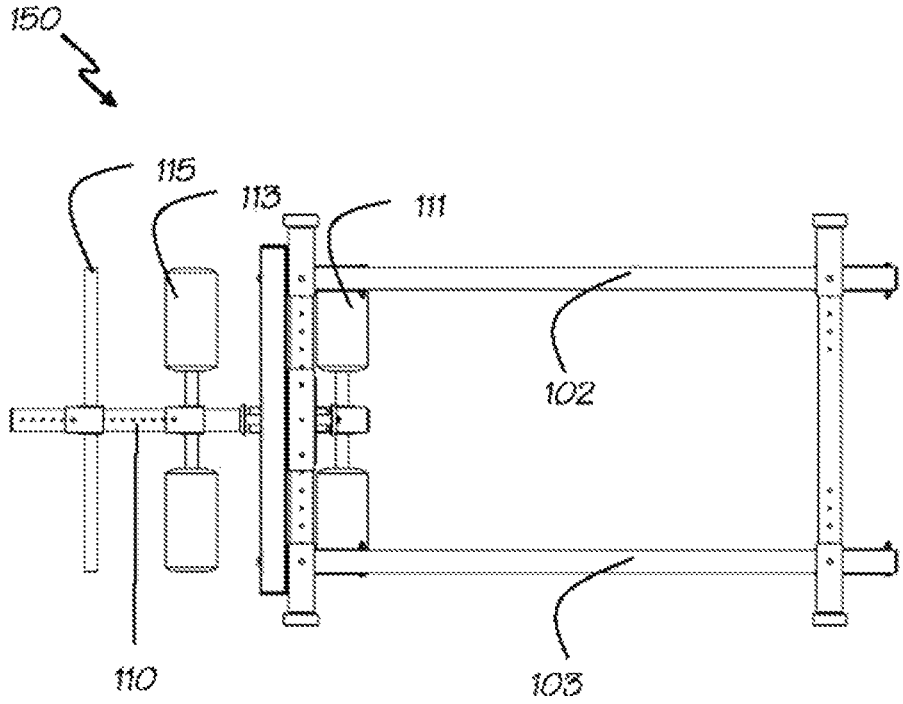
Figure 7C:
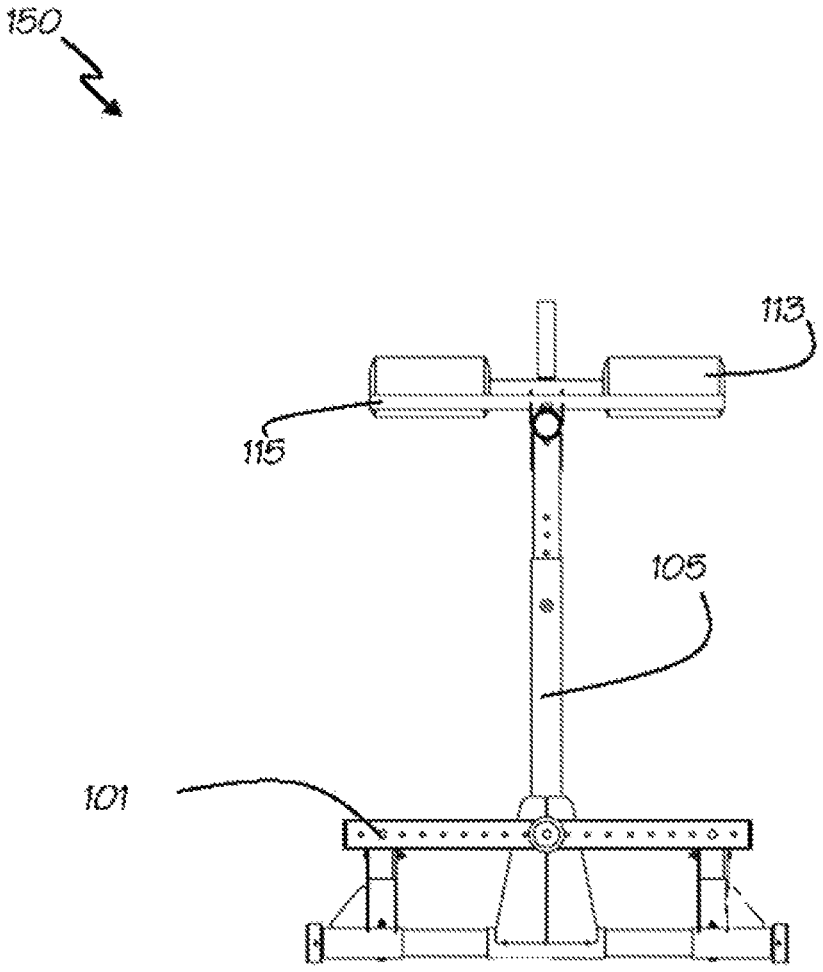

Referring now to FIG. 6 showing a further embodiment 150 of the exercise apparatus, support stem 105 is height adjustable as indicated by arrow 105*b*. The support stem 105 comprises a locking mechanism such as, for example, a locking pin 105*c* as is common to existing exercise apparatus to secure the support stem at a desired height. Vertical adjustment of support stem 105 permits vertical height adjustment of leg support bar 110 and thereby the height of first and second locking pads 111 and 113 to allow the user to be in an ergonomically correct position when mounted on the apparatus.

In particular arrangements, the leg support bar 110 is pivotable with respect to the support stem 105. In this arrangement, the pivotable leg support bar 110 is secured to the support stem 105 by a pivot joint 109 shown in FIG. 2.

The pivot joint 109 may enable rotation 121 of the leg support bar 110 about the support stem 105 having the pivot joint 109 forming the pivot point for the rotation 121. The rotation 121 about the support stem is a rotation in the horizontal plane of the apparatus and in the plane of support beams 102 and 103, for example, to rotate the leg support bar 110 about its longitudinal axis such that support pads 111 and 113 are rotated to be disposed vertically with respect to the ground. In further arrangements, pivot joint 109 may also enable adjustment of the pitch (tilt) 123 of the leg support bar 110 with respect to a horizontal plane. As will be appreciated the pitch adjustment 123 of the leg support bar 110 is in a vertical plane. Tilting of leg support bar 110 may be particularly advantageous to allow the user to obtain a comfortable supported position for advanced exercises, such as, for example, a reverse plank.

In further arrangements, the leg support bar 110 is length-adjustable (see FIG. 2) such that adjustment of the length of the leg support bar 110 acts to either increase or decrease the distance between the proximal and distal ends 112 and 114 of the leg support bar 110 and hence to vary the distance between the first and second locking pads 111 and 113 thereby to comfortably accommodate users of different height and different leg lengths (i.e. in particular users with differing lower leg lengths). The locking pads 111 and 113 hold the user's 200 thighs in a right angle to the torso, thereby taking the strain off the lower back. In other arrangements, the leg support bar 110 is length-adjustable such that adjustment of the length of the leg support bar 110 acts to vary the distance between the proximal and the distal ends 112 and 114 of the leg support bar 110 and hence also a distance between the first locking pad 111 and the foot locking bar 115 thereby to comfortably accommodate users of different height (see arrow 110*a* of FIG. 6).

In particular arrangements, the frame of exercise apparatus may be constructed from a material comprising either, steel, aluminium or other suitable metallic substance to provide sufficient strength in the frame to counter the torque forces subjected to the frame by a user performing an exercise on the apparatus. Base 101 may be a heavy duty base to provide sufficient stability to apparatus 100 whilst a user is mounted and performing exercises thereon, and also as a means of supporting support stem 105 to which the leg locks 111 and 113 are attached. The support stem 105 can be fixed to base 101 or alternatively it may be connected to base 101 by a point of pivot or point or attachment to enable respectively either: folding of the support stem to a lay flat position with respect to the base 101; or dismantling of the support stem 105 from base 101; in both cases to enable the apparatus to be stored without consuming an excessive amount of space.

In further arrangements, the exercise apparatus 100 further comprises one or more handles (not shown) to assist the user 200 when mounting or dismounting from the exercise apparatus 100. In particular arrangements, the handles may be connected to the front of the leg support bar (i.e. proximal end 112 of leg support bar 110).

It will be appreciated that the apparatus described/illustrated above at least substantially provide an improved exercise apparatus to enable an exerciser to perform core exercises with minimal or reduced strain and thus reduced chance of injury.

The arrangements of an exercise apparatus as described herein, and/or shown in the drawings, are presented by way of example only and are not limiting as to the scope of the invention. Unless otherwise specifically stated, individual aspects and components of the exercise apparatus may be modified, or may have been substituted therefore known equivalents, or as yet unknown substitutes such as may be developed in the future or such as may be found to be acceptable substitutes in the future. The exercise apparatus may also be modified for a variety of applications while remaining within the scope and spirit of the claimed invention, since the range of potential applications is great, and since it is intended that the presently disclosed exercise apparatus be adaptable to many such variations.

INTERPRETATION

In Accordance with:

As described herein, 'in accordance with' may also mean 'as a function of' and is not necessarily limited to the integers specified in relation thereto.

Embodiments:

Reference throughout this specification to "one arrangement" or "an arrangement" means that a particular feature, structure or characteristic described in connection with the embodiment is included in at least one arrangement of the present invention. Thus, appearances of the phrases "in one arrangement" or "in a particular arrangement" in various places throughout this specification are not necessarily all referring to the same arrangement, but may. Furthermore, the particular features, structures or characteristics may be combined in any suitable manner, as would be apparent to one of ordinary skill in the art from this disclosure, in one or more arrangement s.

Similarly it should be appreciated that in the above description of example arrangements of the invention, various features of the invention are sometimes grouped together in a single arrangement, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed arrangement. Thus, the claims following the Detailed Description are hereby expressly incorporated into this Detailed Description, with each claim standing on its own as a separate arrangement of this invention.

Furthermore, while some arrangements described herein include some but not other features included in other arrangements, combinations of features of different arrangements are meant to be within the scope of the invention, and form different arrangements, as would be understood by those in the art. For example, in the following claims, any of the claimed arrangements can be used in any combination.

Specific Details

In the description provided herein, numerous specific details are set forth. However, it is understood that arrangements of the invention may be practiced without these specific details. In other instances, well-known methods, structures and techniques have not been shown in detail in order not to obscure an understanding of this description.

Terminology

In describing the preferred arrangement of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "towards, "rearward", "radially", "peripherally", "upwardly", "downwardly", and the like are used as words of convenience to provide reference points and are not to be construed as limiting terms.

Different Instances of Objects

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Comprising and Including

In the claims which follow and in the preceding description of the invention, except where the context requires otherwise due to express language or necessary implication, the word "comprise" or variations such as "comprises" or "comprising" are used in an inclusive sense, i.e. to specify the presence of the stated features but not to preclude the presence or addition of further features in various embodiments of the invention.

Any one of the terms: "including" or "which includes" or "that includes" as used herein is also an open term that also means "including at least" the elements/features that follow the term, but not excluding others. Thus, including is synonymous with and means comprising.

Scope of Invention

Thus, while there has been described what are believed to be the preferred arrangements of the invention, those skilled in the art will recognize that other and further modifications may be made thereto without departing from the spirit of the invention, and it is intended to claim all such changes and modifications as fall within the scope of the invention.

Although the invention has been described with reference to specific examples, it will be appreciated by those skilled in the art that the invention may be embodied in many other forms.

INDUSTRIAL APPLICABILITY

It is apparent from the above, that the arrangements described are applicable to the mobile device industries, specifically for methods and systems for distributing digital media via mobile devices.

The claims defining the invention are as follows:

1. An exercise apparatus for exercising core muscles of a user, the exercise apparatus comprising:

a base;

at least two support beams extending from said base and adapted to receive an exercise ball;

a support stem extending substantially vertically from said base;

a leg support bar located at a distal end of said support stem and disposed substantially horizontally with respect to said base;

a first locking pad disposed at a proximal end of said leg support bar adapted to engage a posterior surface of said user's knees; and a second locking pad disposed at a distal end of said leg support bar adapted to engage an anterior surface of said user's lower leg;

wherein, in use, said first and second locking pads are adapted to engage said user's legs, said exercise ball is adapted to support weight of said user, and said exercise ball is located in engagement with said at least two support beams such that said at least two support beams allow said exercise ball to roll either closer to or further away from said support stem while said exercise ball supports said weight of said user and said user is able to perform an exercise through a full range of movement of said user's core muscles while remaining supported through said full range of movement.

2. The exercise apparatus according to claim 1 wherein said support stem is movable on a plane perpendicular to said at least two support beams, in a direction perpendicular to said support stem, and said apparatus further comprises a locking bolt to secure said support stem to said base.

3. The exercise apparatus according to claim 1 wherein said support stem is height adjustable.

4. The exercise apparatus according to claim 3 wherein said support stem comprises a locking mechanism to secure said support stem at a desired height.

5. The exercise apparatus according to claim 3 wherein said support stem is adjustable in a direction along said support stem, in a plane perpendicular to said at least two support beams.

6. The exercise apparatus according to claim 4 wherein said locking mechanism comprises a locking pin.

7. The exercise apparatus according to claim 1 wherein said leg support bar is pivotable with respect to said support stem.

8. The exercise apparatus according to claim 7 wherein said leg support bar is pivotable in either a horizontal or vertical plane with respect to said support stem.

9. The exercise apparatus according to claim 7 wherein said pivotable leg support bar is secured to said support stem by a pivot joint.

10. The exercise apparatus according to claim 9 wherein said pivot joint enables rotation of said leg support bar about said support stem such that said pivot joint forms a pivot point for said rotation.

11. The exercise apparatus according to claim 9 wherein said pivot joint enables adjustment of the pitch of said leg support bar with respect to a horizontal plane.

12. The exercise apparatus according to claim 1 wherein said leg support bar is length-adjustable such that adjustment of a length of said leg support bar acts to vary a distance between said proximal and distal ends of said leg support bar and hence also a distance between said first and second locking pads thereby to comfortably accommodate users of different height.

13. The exercise apparatus according to claim 1 wherein said first and second locking pads are formed from a resilient substance to prevent discomfort to said user while performing said core muscle exercises.

14. The exercise apparatus according to claim 1 further comprising one or more handles to assist said user when mounting or dismounting from said exercise apparatus.

15. An exercise apparatus for exercising the core muscles of a user, the exercise apparatus comprising:

a base;

at least two support beams extending from said base and adapted to receive an exercise ball;

a support stem extending substantially vertically from said base;

a leg support bar located at a distal end of said support stem and disposed substantially horizontally with respect to said base;

a first locking pad disposed at a proximal end of said leg support bar adapted to engage a posterior surface of said user's knees;

a foot locking bar located at a distal end of said leg support bar; and a second locking pad disposed at said leg support bar, between said first locking pad and said foot locking bar, said second locking pad adapted to engage an anterior surface of said user's lower leg;

wherein, in use, said first and second locking pads are adapted to engage said user's legs, said exercise ball is adapted to support weight of said user, and said exercise ball is located in engagement with said at least two support beams such that said user is able to perform an exercise through a full range of movement of said user's core muscles while remaining supported through said full range of movement;

wherein said foot locking bar is adapted to permit said user to lock their ankle and/or shin against said second locking pad through exertion of a force through said foot locking bar pushing said user's shin against a resilient substance or padding associated with said second locking pad to provide a secure pressure against said foot locking bar.

16. The exercise apparatus according to claim 15, wherein said support stem is movable on a plane perpendicular to said at least two support beams, in a direction perpendicular to said support stem, and said apparatus further comprises a locking bolt to secure said support stem to said base.

17. The exercise apparatus according to claim 15, wherein said support stem is adjustable in a direction along said support stem, in a plane perpendicular to said at least two support beams.

18. The exercise apparatus according to claim 15, wherein said leg support bar is pivotable in either a horizontal or vertical plane with respect to said support stem.

19. The exercise apparatus according to claim 15, wherein said leg support bar is length-adjustable such that adjustment of a length of said leg support bar acts to vary a distance between said proximal and distal ends of said leg support bar and hence also a distance between said first locking pad and the foot locking bar thereby to comfortably accommodate users of different height.

* * * * *